US010233732B2

(12) United States Patent
Sadek et al.

(10) Patent No.: US 10,233,732 B2
(45) Date of Patent: Mar. 19, 2019

(54) ACTIVE INTEGRATED FLOW CONTROL FOR COMPLETION SYSTEM

(71) Applicant: Schlumberger Technology Corporation, Sugar Land, TX (US)

(72) Inventors: Mohamed Aly Sadek, Missouri City, TX (US); Bryan Stamm, Houston, TX (US); Stephen Dyer, Katy, TX (US); John R. Whitsitt, Houston, TX (US); Oguzhan Guven, Bellaire, TX (US); Parvesh Singh, Rosharon, TX (US); Srinivas Poluchalla, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 199 days.

(21) Appl. No.: 15/224,214

(22) Filed: Jul. 29, 2016

(65) Prior Publication Data

US 2018/0030811 A1 Feb. 1, 2018

(51) Int. Cl.

| | |
|---|---|
| ***E21B 43/04*** | (2006.01) |
| ***E21B 43/12*** | (2006.01) |
| ***E21B 43/16*** | (2006.01) |
| ***E21B 43/30*** | (2006.01) |

(52) U.S. Cl.

CPC ..... *E21B 43/04* (2013.01); *E21B 43/12* (2013.01); *E21B 43/16* (2013.01); *E21B 43/305* (2013.01)

(58) Field of Classification Search

CPC ..... E21B 34/066; E21B 34/10; E21B 33/124; E21B 43/045; E21B 43/14; E21B 43/08; E21B 2034/007

See application file for complete search history.

(56) References Cited

U.S. PATENT DOCUMENTS

| | | | | |
|---|---|---|---|---|
| 8,857,518 | B1 * | 10/2014 | Tips | E21B 33/124 166/313 |
| 2002/0096329 | A1 * | 7/2002 | Coon | E21B 34/12 166/278 |
| 2002/0125008 | A1 * | 9/2002 | Wetzel | A45C 13/02 166/278 |
| 2003/0079878 | A1 * | 5/2003 | Pramann, II | E21B 34/10 166/278 |
| 2003/0089496 | A1 * | 5/2003 | Price-Smith | E21B 43/103 166/278 |
| 2003/0221829 | A1 * | 12/2003 | Patel | A45C 13/02 166/278 |

(Continued)

*Primary Examiner* — Jennifer H Gay

(57) ABSTRACT

A technique facilitates active zonal control over the inflow of fluids into a lateral wellbore completion at individual well zones of a plurality of well zones. The completion may comprise a plurality of sand screens through which inflowing fluids pass before entering an interior of the completion, e.g. before entering an interior of a completion base pipe. A control module is positioned along the completion between well zones. The control module is controlled via electrical control signals and is operatively connected with a plurality of intelligent flow control devices which are located along the completion in corresponding well zones. Based on signals received, the control module individually controls the intelligent flow control devices to allow or block flow into an interior of the completion at each well zone.

20 Claims, 3 Drawing Sheets

(56) References Cited

U.S. PATENT DOCUMENTS

| | | | | |
|---|---|---|---|---|
| 2012/0199346 | A1* | 8/2012 | Patel | E21B 43/04 166/278 |
| 2014/0083682 | A1* | 3/2014 | Grigsby | E21B 43/04 166/250.01 |
| 2014/0083685 | A1* | 3/2014 | Tips | E21B 47/123 166/250.01 |
| 2014/0083691 | A1* | 3/2014 | Tips | E21B 43/08 166/250.15 |
| 2014/0083766 | A1* | 3/2014 | Tips | E21B 43/04 175/24 |
| 2016/0123111 | A1* | 5/2016 | Kim | E21B 34/08 166/53 |
| 2016/0170417 | A1* | 6/2016 | Sun, Jr. | G05D 7/0676 700/282 |
| 2018/0030811 | A1* | 2/2018 | Sadek | E21B 34/066 |

* cited by examiner

ACTIVE INTEGRATED FLOW CONTROL FOR COMPLETION SYSTEM

BACKGROUND

Open hole horizontal completions have been used in horizontal wellbores in the oil and gas industry for hydrocarbon extraction in both sandstone and carbonate formations. To combat early well failure due to sand screen plugging or uncontrolled sand production, completions have been combined with gravel packs to filter out the sand. In at least some of these applications, an electric submersible pumping system is installed in an upper completion which is connected with the lower open hole horizontal completion via a connect-disconnect system. This allows the electric submersible pumping system to be worked over without having to retrieve the lower completion or the monitoring and control equipment installed in the lower completion. In a variety of these applications, obtaining a desired level of control over the inflow of fluids with respect to a plurality of zones along the horizontal wellbore has been difficult.

SUMMARY

In general, a system and methodology facilitate active zonal control over the inflow of fluids into a lateral wellbore completion at individual well zones of a plurality of well zones. The completion is deployed into a lateral wellbore along the plurality of well zones. By way of example, the completion may comprise a plurality of sand screens through which inflowing fluids pass before entering an interior of the completion, e.g. before entering an interior of a completion base pipe. A control module is positioned along the completion between well zones. The control module is controlled via electrical control signals and is operatively connected with a plurality of intelligent flow control devices which are located along the completion in corresponding well zones. Based on signals received, the control module individually controls the intelligent flow control devices to allow or block flow into an interior of the completion at each well zone.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
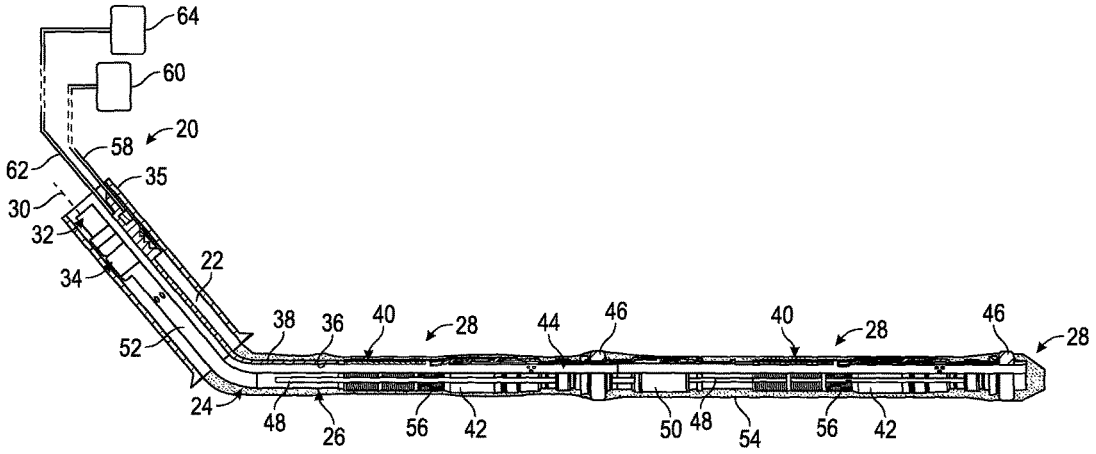
FIG. 1 is an illustration of an example of a completion deployed in a lateral wellbore and combined with an active zonal control system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate active zonal control over the inflow of fluids into a lateral wellbore completion at individual well zones along the lateral wellbore, e.g. horizontal wellbore. In some applications, active, selective control of production from individual well zones may be achieved by using a surface control in combination with a control module positioned along the lateral wellbore completion, e.g. in a middle region of the lateral wellbore completion. By way of example, the control module may work in cooperation with electric or electrohydraulic valves to control an inflow of fluid through intelligent flow control devices.

During production, this active control enables restriction of inflow at specific well zones without employing a mechanical intervention technique. Consequently, inflow of fluids into the completion can be restricted at specific zones when, for example, water and/or gas entry occurs. It should be noted that the control module in combination with the intelligent flow control devices also can be used as a fluid loss control system, thus reducing or eliminating fluid loss control devices such as large bore flapper valves.

According to an embodiment, a lateral completion, e.g. a lower completion, is deployed into a lateral wellbore along the plurality of well zones. In this example, the lateral completion may be deployed in an open hole wellbore and may comprise a plurality of sand screens. Inflowing fluids, such as gravel pack return fluids or production fluids pass inwardly through the sand screens before entering an interior of the lateral completion, e.g. before entering an interior of a completion base pipe. The control module is positioned along the lateral completion between well zones and is controlled via electrical control signals. By way of example, the electrical control signals may be provided by a surface controller. However, downhole controllers, remote controllers, or other suitable controllers may be used alone or in combination to provide the desired electrical control signals.

The control module is operatively connected with a plurality of intelligent flow control devices which are located along the completion in corresponding well zones. In some applications, a single intelligent flow control device is located in each well zone but additional flow control devices may be provided to enable a greater level of flow control along each well zone. Based on electrical signals received, the control module individually controls the intelligent flow control devices to allow or block flow into an interior of the completion at each well zone. In some applications, sensors, e.g. pressure and/or temperature sensors, may be positioned in the well zones to monitor the inflowing fluid and to provide information regarding specific parameters, e.g. characteristics of the inflowing fluid.

Referring generally to FIG. 1, an embodiment of a well system 20 is illustrated. In this embodiment, well system 20 is deployed in a wellbore 22 having a lateral wellbore section 24, e.g. a generally horizontal wellbore section. The well system 20 comprises a completion 26 deployed in wellbore 22. In a variety of applications, completion 26 may be in the form of a lateral completion deployed in lateral wellbore section 24 along a plurality of well zones 28.

In some applications, the lateral completion 26 is a lower completion initially installed downhole and then coupled with an upper completion 30 (shown in dashed lines) via a connect-disconnect system 32. An artificial lift system, e.g. an electric submersible pumping system, may be deployed as part of or in cooperation with the upper completion 30 to produce fluids received via lateral completion 26. During a production operation, the lateral wellbore section 24 may be isolated via a packer 34, such as a production packer, set against a surrounding casing 35.

Figure 2:
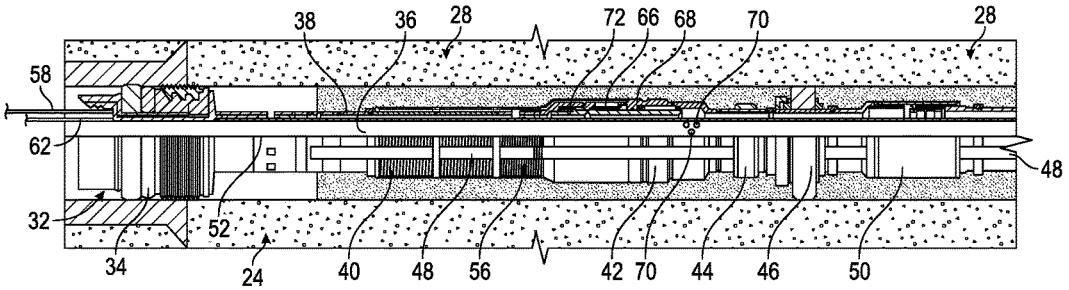
FIG. 2 is an illustration of an enlarged portion of the completion illustrated in FIG. 1, according to an embodiment of the disclosure.

With additional reference to FIG. 2, lateral completion 26 comprises an interior flow region or passage 36 which may be along the interior of a base pipe 38. The lateral completion 26 also comprises a plurality of sand screens 40 disposed about the base pipe 38 and located in corresponding well zones 28. Additionally, the lateral completion 26 comprises a plurality of intelligent flow control devices 42 with at least one intelligent flow control device located in each well zone 28.

By way of example, an individual sand screen section 40 may be located in each well zone 28 and a single intelligent flow control device 42 may be placed in fluid communication with that corresponding sand screen 40 in the corresponding well zone 28. The intelligent flow control devices 42 are individually controlled via a control module 44. In a variety of applications, the control module 44 may be located between sand screens 40 and between well zones 28, e.g. at a generally central or middle location with respect to the plurality of well zones 28. The well zones 28 may be separated and isolated via isolation packers 46 which are deployed in an un-set state and then set against the surrounding open hole wellbore wall, as illustrated.

To facilitate gravel packing of lateral wellbore 24, the completion 26 also may comprise a plurality of shunt tubes 48 which deliver the gravel packing slurry to sequential well zones 28. The shunt tubes extending through sequential well zones 28 may be joined at a shunt tube isolation valve structure 50 having valves for controlling the flow of gravel slurry. The valves in valve structure 50 serve to further isolate adjacent well zones 28 when the valves are closed, e.g. closed after gravel packing. During a gravel packing operation, gravel packing slurry is delivered via a service tool and then diverted from the inside diameter to the annulus surrounding completion 26 via a port closure sleeve 52. The gravel slurry flows along the annulus and shunt tubes 48 to form a uniform gravel pack 54.

In an operational example, the gravel slurry begins packing from the heel of the well and as the gravel/sand settles the dehydration fluid travels along a drainage layer between the first sand screen 40 and a solid section of the base pipe 38. The dehydration fluid travels along this fluid return path until reaching a first sliding sleeve 56 of a plurality of sliding sleeves. In some applications, some of the returning dehydration fluid also flows through the corresponding flow control device 42. The dehydration fluid then flows into interior 36 and back to the surface through the base pipe 38 and corresponding tubing. Upon completion of the heel zone, the gravel slurry pumping operation is continued and this process is repeated at subsequent well zones 28, with the aid of shunt tubes 48, until screen out pressure is reached and the pumps are stopped.

Once the service tool is retrieved, the upper completion 30 is deployed downhole and engaged with the lower completion 26 to establish communication from the surface to the lower completion 26. For example, electrical and/or hydraulic communication may be established through the connect-disconnect 32 which can be in the form of an electrically powered connect-disconnect system. Electrical power and electrical control signals may be provided to the control module 44 via an electric line 58 routed through the connect-disconnect 32. The electric line 58 may be coupled with a control system 60, e.g. a computer-based control system, located at the surface or at another suitable location.

Additionally, hydraulic power may be provided to control module 44 to enable selective actuation of the intelligent flow control devices 42 via a hydraulic line 62. The hydraulic line 62 may similarly be routed through the connect-disconnect 32 and coupled with a hydraulic pump and control system 64 located at the surface or at another suitable location. It should be noted the electric line 58 may comprise a single or multiple conductive paths for carrying electrical power, control signals, and/or data signals, e.g. data signals from sensors or other downhole equipment. Similarly, the hydraulic line 62 may comprise a single flow path or a plurality of flow paths for carrying hydraulic actuation fluid.

Each intelligent flow control device 42 may comprise a single valve 66 or a plurality of valves 66 which work in cooperation with the corresponding sand screen 40. When valve 66 is open, fluid flows inwardly through the corresponding sand screen(s) 40 and is able to move along the drainage layer between the base pipe 38 and sand screen(s) 40 from locations both uphole and downhole of the intelligent flow control device 42. The fluid flows into a manifold 68 of the flow control device 42 and is routed through valve 66 and into interior 36 through an opening or openings 70, e.g. radial openings through base pipe 38.

Additionally, each intelligent flow control device 42 further comprises a controllable actuator 72 coupled to the valve 66 to enable selective opening and closing of valve 66. The controllable actuator 72 is controlled via control module 44 according to instructions received via electrical control signals carried by electric line 58 from the corresponding downhole and/or surface control system 60. The controllable actuator 72 in each intelligent flow control device 42 may be actuated electrically, hydraulically, or by other suitable technique. For example, the flow control device 42 may be in the form of an electrically actuated motor and plunger assembly, an electro-hydraulic assembly, or a hydraulic assembly responding to hydraulic input received via control module 44.

Figure 3:
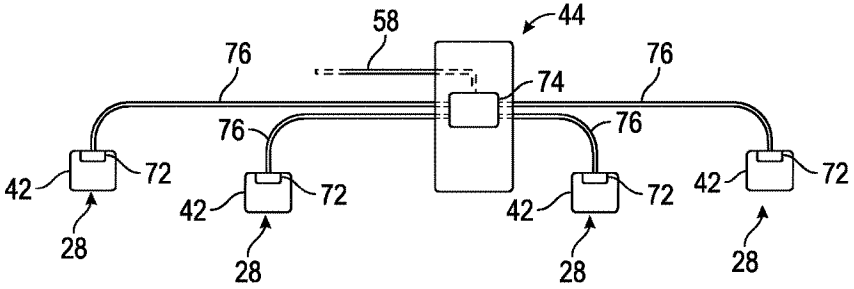
FIG. 3 is a schematic illustration of an example of a zonal control system utilizing a control module combined with a plurality of intelligent flow control devices, according to an embodiment of the disclosure.
Figure 4:
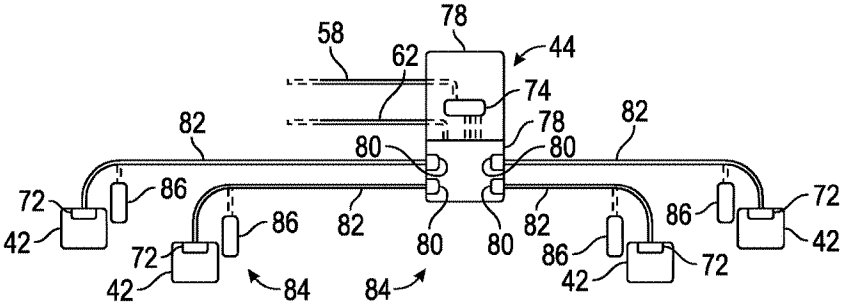
FIG. 4 is a schematic illustration of another example of a zonal control system utilizing a control module combined with a plurality of intelligent flow control devices, according to an embodiment of the disclosure.

Referring generally to FIGS. 3 and 4, schematic representations of embodiments of the overall electronically controlled system for providing flow control in each well zone 28 is illustrated. According to the embodiment illustrated in FIG. 3, the control module 44 comprises a controller 74 which receives electrical control signals via electric line 58. The controller 74 may be carried on a printed circuit board or it may be otherwise suitably configured in control module 44.

In this example, the controller 74 is operatively coupled with controllable actuators 72 via electrical control lines 76. The controllable actuator 72 in this type of control structure may be in the form of an electrically actuated motor or other suitable electrically powered actuator. Based on instructions received by control module 44 from control system 60, a specific controllable actuator 72 may be actuated to shift the corresponding valve or valves 66 to an open or closed position. The ability to selectively close the valve(s) 66 allows the inflow of fluid within a specific well zone or zones 28 to be closed off when desired. If, for example, water or other undesirable fluids begin to flow into completion 26 at one or more of the well zones 28, appropriate control signals may be provided to control module 44 so as to actuate the corresponding controllable actuator 72 and to shut off further inflow of fluid into completion 26 at the corresponding well zone(s) 28.

According to another embodiment illustrated in FIG. 4, the control module 44 again comprises controller 74 which receives electrical control signals via electric line 58. In this embodiment, however, the control module 44 comprises a hydraulic manifold 78 which receives hydraulic actuating fluid under pressure via hydraulic line 62. The controller 74 is used to control electrically operated valves 80 within hydraulic manifold 78.

In this example, the controller 74 is operatively coupled with the valves 80 within control module 44 to enable control over the flow of pressurized hydraulic actuating fluid from hydraulic line 62 to each of the controllable actuators 72. Hydraulic actuating fluid is delivered to hydraulic manifold 78 via hydraulic line 62 and then valves 80 are selectively actuated to enable flow of the actuating fluid to corresponding controllable actuators 72 via downstream hydraulic control lines 82. The controllable actuators 72 in this type of control structure may be in the form of a hydraulically actuated piston assembly or other suitable hydraulically powered actuator.

Based on instructions received by control module 44 from control system 60, the controller 74 provides an appropriate control signal to the corresponding electrically operated valve 80. The electrically operated valve 80 is opened or closed according to the control signal received and thus allows or blocks flow of actuating fluid to the corresponding controllable actuator 72. Consequently, individual actuators 72 may be operated to enable control over the inflow of well fluid (and/or gravel packing dehydrating fluid) within a specific well zone or zones 28.

In various production operations, for example, the control over individual actuators 72 at individual intelligent flow control devices 42 enables the inflow of fluid within a specific well zone or zones 28 to be closed off when desired. If, for example, water or other undesirable fluids begin to flow into completion 26 at one or more of the well zones 28, appropriate control signals may be provided to control module 44 so as to actuate the corresponding controllable actuator 72 and to shut off further inflow of fluid into completion 26 at the corresponding well zone(s) 28.

In some applications, improved control over the inflow of fluids at specific well zones 28 may be enhanced by using a sensor system 84. The sensor system 84 may comprise a plurality of sensors 86 with one or more sensors 86 located in each well zone 28. For example, pressure and/or temperature sensors 86 may be located in each well zone 28, although sensors 86 may comprise various other types of sensors. The sensors 86 are used to monitor desired parameters, such as inflowing fluid characteristics, and data on those parameters is provided to controller 74 and/or control system 60. The sensors 86 may be utilized in combination with the various zonal control system embodiments described herein.

The size and structure of well system 20 may vary according to the specifics of a given environment and/or well application. For example, the lateral completion 26 may be constructed with various numbers of screen sections 40 associated with corresponding numbers of well zones 28. Additionally, the lateral completion 26 may comprise a variety of other or additional components selected to facilitate gravel packing operations, production operations, servicing operations, and/or other operations with respect to well zones 28 and the corresponding surrounding formation. Similarly, the upper completion 30 may comprise a variety of components and may be operated with various types of artificial lift systems.

The structure, size, and components of control module 44 and flow control devices 42 also may be adjusted according to the parameters of a given application. The electric line 58 may comprise separate lines for power and data or a combined power/data line. The control system 60 and electric line 58 may be used for carrying a variety of signals along a wholly hardwired electrical communication line or a partially wireless communication line. Such adjustments to the well system may be made according to equipment, environmental, and/or other considerations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a completion disposed in an open hole, lateral wellbore, the completion comprising:

a base pipe;

a plurality of sand screens disposed about the base pipe in a plurality of well zones along the open hole, lateral wellbore;

an intelligent flow control device in each well zone of the plurality of well zones, each intelligent flow control device having a controllable actuator which is shiftable between an open position allowing fluid flow into the base pipe and a closed position blocking flow into the base pipe; and an individual control module located between well zones of the plurality of well zones, the individual control module controlling each controllable actuator individually to place each intelligent flow control device in a specific flow position based on control signals received by the individual control module, thus enabling control over a plurality of the intelligent flow control devices from the individual control module while it is located at a generally middle location along the completion disposed in the open hole, lateral wellbore.

2. The system as recited in claim 1, wherein the completion further comprises at least one isolation packer positioned between adjacent well zones to isolate the adjacent well zones from each other along the open hole, lateral wellbore.

3. The system as recited in claim 2, wherein the at least one isolation packer comprises a plurality of isolation packers.

4. The system as recited in claim 1, wherein the completion comprises a port closure sleeve to facilitate a gravel packing operation.

5. The system as recited in claim 4, wherein the completion comprises a plurality of shunt tubes to deliver a gravel slurry to well zones of the plurality of well zones during the gravel packing operation.

6. The system as recited in claim 1, wherein the individual control module is controlled via electric signals provided via a surface controller.

7. The system as recited in claim 1, wherein the completion further comprises a plurality of sensors to monitor at least one parameter in each well zone.

8. The system as recited in claim 1, wherein the controllable actuator of each intelligent flow control device is electrically controlled.

9. The system as recited in claim 1, wherein the controllable actuator of each intelligent flow control device is hydraulically controlled.

10. A system, comprising:

a completion deployed in a wellbore along a plurality of well zones, the completion comprising:

an individual control module located between well zones of the plurality of well zones; and a plurality of intelligent flow control devices coupled to the individual control module, the plurality of intelligent flow control devices being positioned so that at least one intelligent flow control device is located in each well zone to allow or block flow of fluid from an exterior of the completion to an interior of the completion, the individual control module being coupled to each intelligent flow control device of the plurality of intelligent flow control devices to individually control whether each intelligent flow control device allows or blocks the flow of fluid into the completion based on electric control signals received by the individual control module.

11. The system as recited in claim 10, wherein each intelligent flow control device receives fluid which flows into a corresponding sand screen.

12. The system as recited in claim 10, wherein the plurality of intelligent flow control devices remain open during a gravel packing operation and a production operation and are then individually closed upon detection of an undesirable fluid in a corresponding well zone.

13. The system as recited in claim 10, wherein each intelligent flow control device comprises an actuator controllable by the individual control module, the actuator being a hydraulically controlled actuator.

14. The system as recited in claim 10, wherein each intelligent flow control device comprises an actuator controllable by the individual control module, the actuator being an electrically controlled actuator.

15. The system as recited in claim 10, wherein the completion is deployed in a lateral wellbore, the completion comprising isolation packers positioned to isolate the well zones from each other along the lateral wellbore.

16. The system as recited in claim 15, wherein the individual control module is positioned between intelligent flow control devices of the plurality of intelligent flow control devices along the lateral wellbore.

17. A method, comprising:

deploying into a lateral wellbore a completion with a plurality of sand screens arranged in a plurality of corresponding well zones of the lateral wellbore;

positioning a single control module between sand screens of the plurality of sand screens;

locating an intelligent flow control device in each zone to control the flow of fluid entering through corresponding sand screens; and using the single control module to individually control the intelligent flow control devices to allow or block flow into an interior of the completion at each well zone.

18. The method as recited in claim 17, further comprising utilizing shunt tubes to facilitate gravel packing of the plurality of corresponding well zones and returning gravel packing fluid into the completion via the intelligent flow control devices.

19. The method as recited in claim 18, further comprising initiating a production operation following gravel packing and providing electrical control signals to the single control module to control the inflow of fluid through each intelligent flow control device.

20. The method as recited in claim 19, further comprising using sensors along the completion to monitor a fluid parameter at each well zone.

* * * * *